US005776001A

United States Patent [19]

Carter

[11] Patent Number: 5,776,001

[45] Date of Patent: Jul. 7, 1998

[54] THREAD FORMATION

[75] Inventor: Nigel Carter, Leeds, England

[73] Assignee: CCL Systems Limited, Leeds, England

[21] Appl. No.: 687,451

[22] PCT Filed: Feb. 15, 1992

[86] PCT No.: PCT/GB95/00309

§ 371 Date: Oct. 3, 1996

§ 102(e) Date: Oct. 3, 1996

[87] PCT Pub. No.: WO95/22422

PCT Pub. Date: Aug. 24, 1995

[30] Foreign Application Priority Data

Feb. 16, 1994 [GB] United Kingdom ..... 9402966

[51] Int. Cl.[6] ..... B21H 3/02

[52] U.S. Cl. ..... 470/8; 470/12; 72/318; 72/358; 29/446

[58] Field of Search ..... 470/8, 10, 11, 470/12, 66, 84; 72/318, 358, 103, 104; 29/446

[56] References Cited

U.S. PATENT DOCUMENTS

| | | | |
|---|---|---|---|
| 2,060,593 | 11/1936 | Schaurte et al. | 470/8 |
| 4,018,132 | 4/1977 | Abe | 470/57 |
| 4,584,247 | 4/1986 | Mulholland | 470/84 |
| 4,739,601 | 4/1988 | Beine | 52/710 |
| 4,996,860 | 3/1991 | Shinjo | 72/88 |
| 5,054,146 | 10/1991 | Wiesenfeld et al. | 10/27 |

FOREIGN PATENT DOCUMENTS

| | | | |
|---|---|---|---|
| 58-97453 | 6/1983 | Japan | 72/104 |
| 772 103 | 4/1957 | United Kingdom . | |
| 1 263 533 | 2/1972 | United Kingdom . | |
| 1 334 153 | 10/1973 | United Kingdom . | |
| 2 227 802 | 8/1990 | United Kingdom . | |

OTHER PUBLICATIONS

Degarmo et al, *Materials and Processes in Manffacturing*, 1994, pp. 353–356.

International Publication No. WO 93/24257 published Dec. 9, 1993.

WO.A.93 24257 Dec. 1993.

*Primary Examiner*—Lowell A. Larson

*Assistant Examiner*—Ed Tolan

*Attorney, Agent, or Firm*—Nikaido, Marmelstein, Murray & Oram LLP

[57] ABSTRACT

The invention relates to thread formation and particularly to the formation of threads on deformed steel reinforcing rods. The method of forming a thread on the steel reinforcing rod comprises the steps of cold upsetting an end region (1) of a deformed steel reinforcing rod having a nominal diameter, the upsetting being arranged to increase the diameter of the end region to a new, upset, diameter greater than the nominal diameter, rolling a thread onto the end region (1) so as to produce a threaded region having a thread major diameter which is greater than the nominal diameter and a thread minor diameter which is less than the nominal diameter. The formation of such a thread enables the production of mechanical connections between pairs of rods, the connections having a strength greater than that of the rods being connected to one another.

25 Claims, 4 Drawing Sheets

Figure 3I:
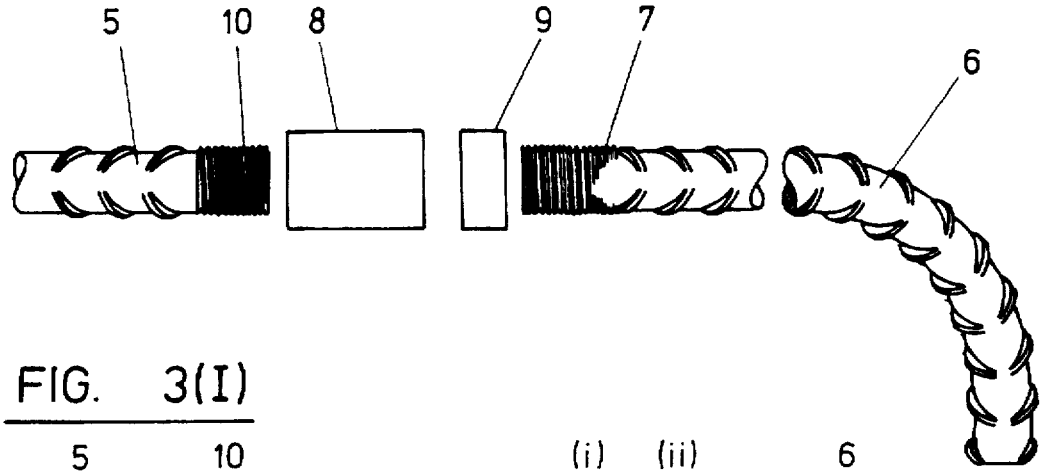
Figure 3:
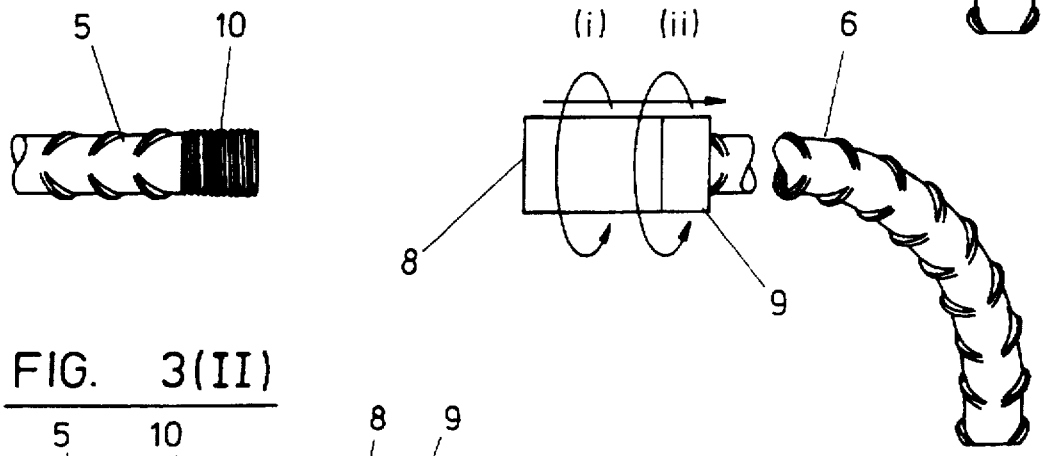
Figure 3:
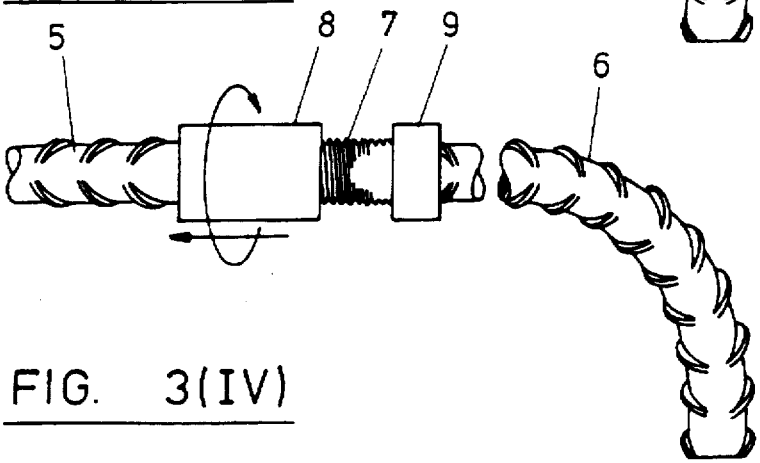

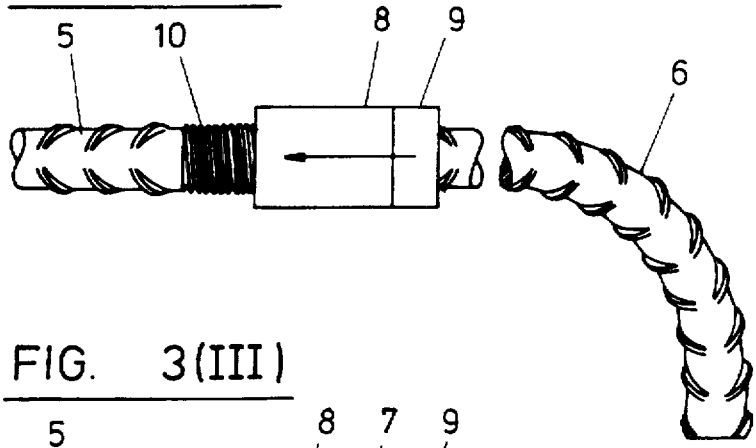
FIG. 3(III)

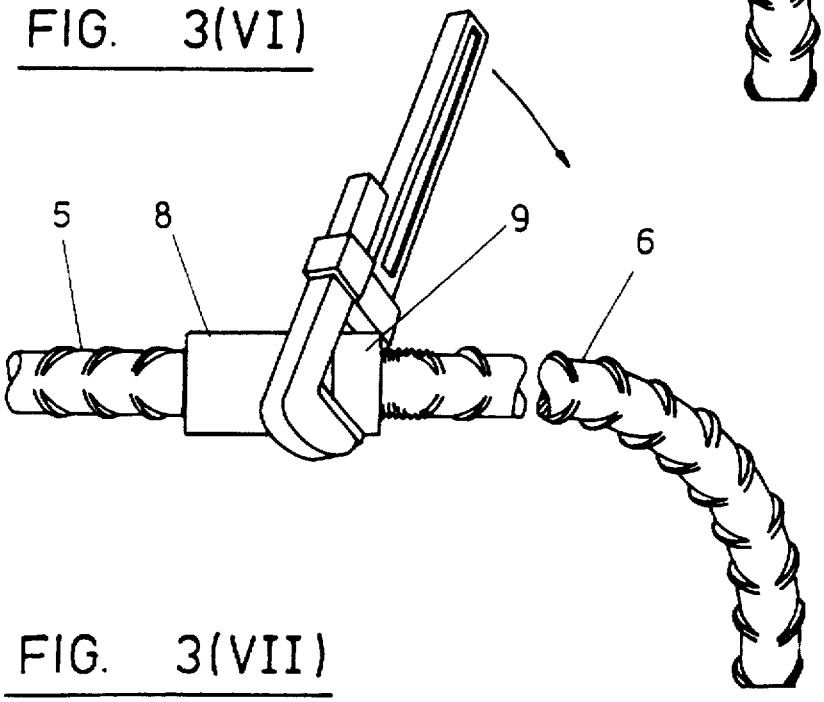
FIG. 3(VII)

THREAD FORMATION

The invention relates to thread formation. Particularly the invention relates to the formation of threads on deformed steel reinforcing rods for reinforced concrete structures.

According to an aspect of the invention, the invention provides a method of forming a thread on at least one end region of a deformed steel reinforcing rod, the method comprising:

cold upsetting an end region of the rod having a nominal diameter, so as to increase the diameter of the end region to a new, upset, diameter greater than the nominal diameter; and rolling a thread onto the end region, so as to produce a threaded region having a thread major diameter, which is greater than the nominal diameter and a thread minor diameter which is less than the nominal diameter.

The formation of such a thread enables the production of mechanical connections between pairs of rods, the connections having a strength greater than that of the rods being connected to one another.

Preferably, upsetting the end region produces an upset end region having a length which is typically 110% of the thread diameter (taken from peak to peak).

Preferably, the method further comprises a step of skimming the end region of the rod.

Preferably, said step of skimming the end region of the rod is carried out intermediate said cold upsetting and thread rolling steps.

Preferably, the thread minor diameter is no greater than 90% of the nominal diameter of the rod.

Preferably, rolling the thread onto the end region produces a thread having an effective diameter larger than the nominal diameter.

Preferably, the upset diameter of the end region of the rod is no greater than 110% of the nominal diameter D.

Preferably, the thread is of a formation having enlarged major and minor root radii.

Preferably, the thread is of a relatively coarse pitch, to enable a greater speed of assembly when forming a connection to the end of the rod.

The thread is preferably a parallel thread.

The upsetting operation as specified above produces full formed rolled threads. The effective diameter of such threads is typically around 5% greater than the nominal diameter of the bar.

Such "minimal" upsetting reduces the volume of upset material by up to 70% compared with prior systems, yet rod strength is not compromised by the reduced upsetting.

A further benefit of cold minimal upsetting is that this gives an important advantage of enabling transportable equipment to be used. In addition, minimal upsetting may be carried out during a much shorter time period than is required by prior art systems. Typically, the time saving over previous cold upsetting systems is in the order of 60%.

Other prior systems using hot forging methods to produce threaded rods have substantially higher energy requirements than that of the present invention due to their need to preheat the end regions of the rod.

Whenever any type of upsetting is utilized to increase the diameter of a region of a rod, rod length is always reduced. By minimizing the amount of upset, a further beneficial effect is that rod length is only reduced by a very small amount.

A yet further advantage of the combination of providing a minimal upset and thread rolling is that a smaller diameter and shorter connecting sleeve (coupler) than was previously possible may be utilized to connect two threaded ends together, and this has the beneficial effect of ensuring that rods joined in this manner have the least stiffening effect caused by a full strength mechanical joint.

Furthermore, if a coupler of smaller diameter is used then less concrete is required to cover the rods.

The invention includes threaded rods produced in accordance with the abovementioned method.

Figure 1A:
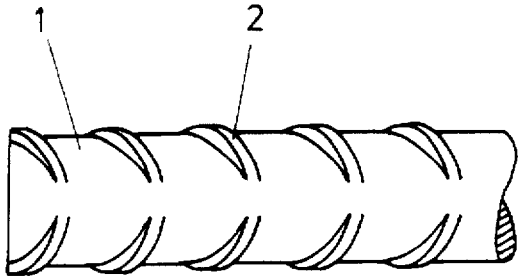
Figure 1B:
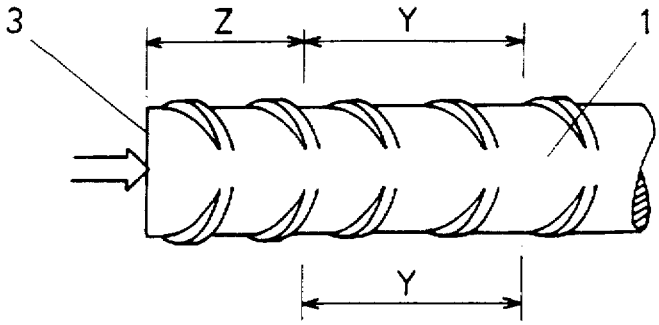
Figure 1C:
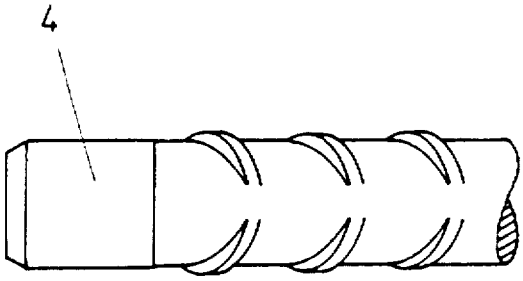
Figure 1D:
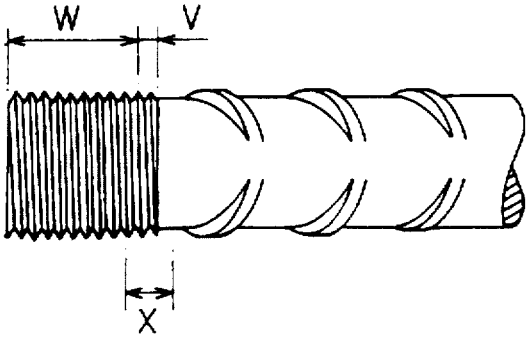
Figure 2:
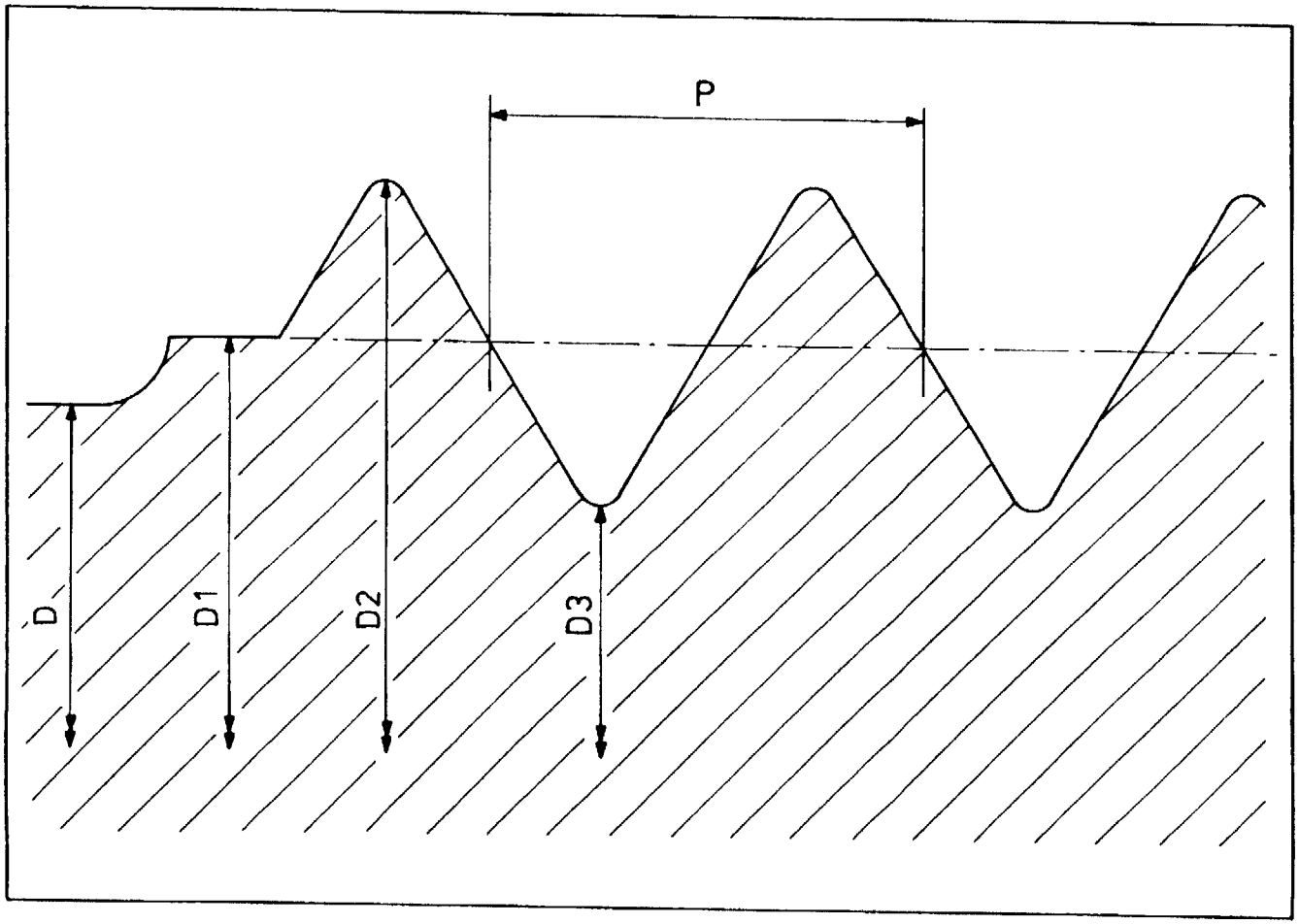

An embodiment of the present invention will now be described, by way of example, with reference to the accompanying diagrammatic drawings, in which:

FIGS. 1A to 1D schematically show a method of thread formation in accordance with the present invention;

FIG. 2 is an enlarged cross-sectional view showing a region "X" of the rod shown in FIG. 1D; and FIGS. 3(I) to 3(VII) illustrate a method for connecting together a pair of deformed steel reinforcing rods, by means of a coupler.

Referring initially to FIGS. 1A to 1D, a method of thread formation will now be described. FIG. 1A shows an end region 1 of a reinforcing rod for use in the reinforcement of concrete structures. The rod 1 has a number of ridges 2 (which are conventional) to provide a mechanical key between steel and concrete within a completed concrete structure.

The first step in the method of the present invention involves gripping the rod 1, by holding a region Y firmly within a die and exerting compressive pressure on an end face 3 of the rod. Applying this compressive force results in the end part of the rod being upset slightly with respect to the rest of the rod. The amount of upsetting is carefully controlled so as to provide an initial upset of no more than 10% increase in diameter over the nominal diameter of the rod 1 for a length Z of approximately 110% of a thread diameter D2 (shown in FIG. 2—to be discussed later).

Limiting the amount of upset to this maximum figure has the beneficial effects of minimising reductions in the length of the rod 1 caused by such compression.

A rod which has undergone this minimal upsetting procedure is shown in FIG. 1B. The next step in the operation shown is to skim and chamfer the end of the rod so as to remove the ridges 2 from the minimally upset region so as to provide a cleaned up end 4. This skimming process may be achieved simply by performing a turning operation on the end of the rod.

The final step of the method is to roll a thread onto the skimmed region 4 so as to arrive at the situation shown in FIG. 1D.

The region W shown in FIG. 1D extends over a length which is substantially equal to the diameter of the thread D2, and a lead-in region V is provided as shown which comprises a partially threaded area formed at the inner extent of the threaded region of the bar. The combination of the partially threaded region V and the fully threaded region W being equal to the length Z shown in FIG. 1B.

The method may be performed at a construction site, and need not be performed in a factory or workshop. This is a significant advantage over prior systems, which carry out hot upsetting, as hot upsetting must be carried out at a factory, and this severely limits its application and rules out any on-site usage.

It has also been found that the system of the present invention requires less equipment than was required for prior cold upsetting systems.

Another advantage over prior systems, both hot and cold, is that these prior systems tend to push a large amount of material further down the rod itself. The equipment utilized for the present invention ensures that material flow is limited, and thereby prevents the formation of a long tapering neck of material. In prior systems, this neck is effectively wasted material leading to an unnecessary reduction in the length of the rod as a whole.

Referring now to FIG. 2, an area "X" of the threaded end of the rod 1 is shown.

In the Figure, various reference letters D, D1, D2 and D3 are used and these refer to, respectively, the nominal diameter of the rod, the preturned (skimmed) diameter corresponding to the diameter of the skimmed region 4 in FIG. 1C, the thread major diameter and the thread minor diameter.

It should be noted that rolling the thread onto the preturned end 4 of the rod causes material which was previously below the dotted line shown in FIG. 2, to be displaced to a position above the dotted line. In this manner, the threaded region is in fact subjected to a second cold working operation—the first being achieved when compressing the end of the rod as shown in FIG. 1B.

The combination of the benefits of thread rolling together with the enhanced mechanical properties achieved by the minimal upsetting provides the threaded region with strength characteristics which are equal to or greater than the characteristics of the unthreaded regions of the rod.

With regard to the various relative dimensions of D, D1, D2 and D3, the preturned diameter D1 is typically no more than 5% larger than the nominal diameter of the rod D, and D3, the minor diameter of the thread, undercuts D by around 12%.

As a consequence of the method, a much smaller thread size is required than that which was previously required, with prior systems. This, in itself, presents major advantages in that with a reduced thread size, it is possible to manufacture smaller couplers for linking threaded ends of rods together. By having a smaller diameter coupler, it is possible to reduce the amount of concrete which is used in a structure. This is because building codes of practice require a minimum thickness of concrete be between any point of the reinforcing rods, and the surface. By reducing the thread size, the overall diameter including the coupler, is thereby reduced and therefore less concrete is required to cover structure as a whole.

It has also been found that a coarser pitch of thread ("P" of FIG. 2) may be achieved meaning less turns per threaded meter, and this leads to an increased speed of assembly as fewer turns of a coupler are required. Typically, the assembly times can be reduced by 20%.

Although the invention is not limited to a particular type of thread, it has been found to be advantageous to provide threads which have increased minor and major root radii. Doing this has been found to provide benefits in the form of reducing the stress concentration factor within the thread itself so as to provide further benefits in terms of improved fatigue life.

FIGS. 3(I) to 3(VII) show a manner in which a pair of reinforcing rods may be connected together.

Referring to the FIGS. 3(I) to 3(VII), it will be noted that a first reinforcing rod 5 has a threaded end region 10 similar to that of the reinforcing rod shown in FIG. 1. The other reinforcing rod 6 is shown having an extended thread 7 which runs further down the reinforcing rod 6 and extends onto non-upset regions of the rod, but in those regions, the thread is not fully formed but serves to allow a coupler 8 and lock nut 9 to be fully screwed onto the rod 6.

Although the threaded region of the rod 6 appears different to that of FIGS. 1 and 2, it should be appreciated that the thread is, in fact, formed in accordance with the method described in relation to those Figures. The thread of the bar 6 being fully formed only in those regions which have been subjected to the minimal upsetting operation.

The method of connecting rod 5 to rod 6 will now be described.

In FIG. 3(II) the lock nut 9 and coupler 8 are screwed onto rod 6 until an end region of the coupler 8 is approximately flush with the end of rod 6. Thereafter, in FIG. 3(III), the rod 6 is moved towards rod 5 until their ends abut. Coupler 8 is then rotated in FIG. 3(IV) onto rod 5 until it reaches the thread run out on that bar and, at this point, the abutment region between the two rods is approximately mid-way along the coupler 8.

Figure 3V:
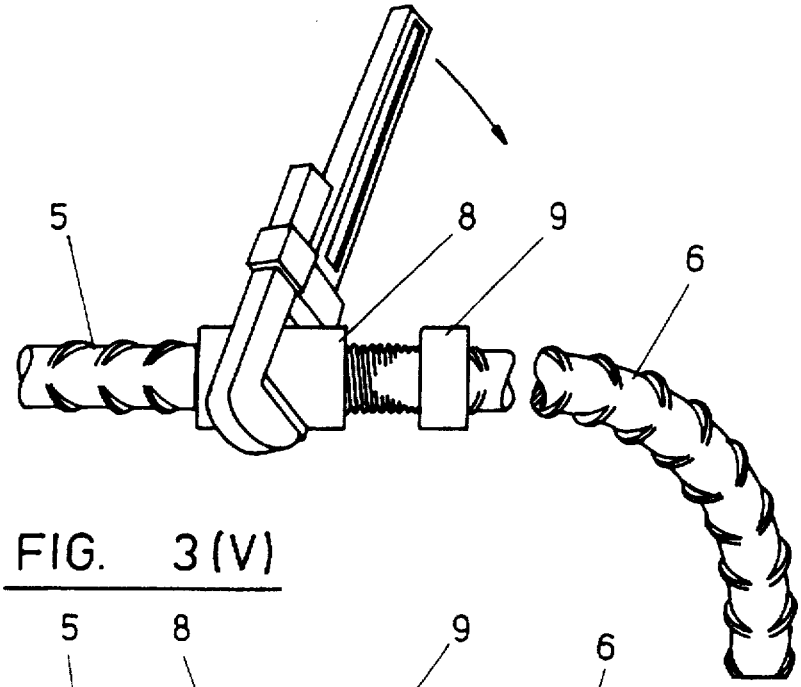
Figure 3:
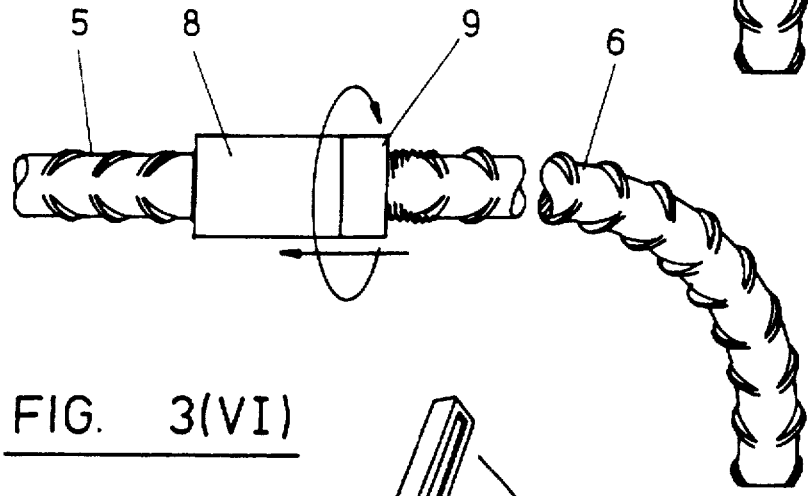

In FIG. 3(V), a wrench is shown being used to ensure that the coupler 8 is at the end of the thread run out of rod 5. In FIG. 3(VI), the lock nut 9 is moved towards coupler 8, by rotation, and in FIG. 3(VII), the wrench is used to tighten the lock nut 9 so as to prevent further movement of the coupler 8.

The method of assembling reinforcement rods 5 and 6 utilizing the system shown is particular advantageous as only rotation of the coupler and lock nut is required, and no rotation of either of the rods is necessary.

Of course, many different variations of the coupling technique shown may be envisaged, and it may not be necessary to utilize a lock nut.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A method of forming a thread on at least one end region of a deformed steel reinforcing rod, wherein the threaded region has strength characteristics which are greater than or at least equal to the strength characteristics of the un-threaded region, the method comprising:

cold upsetting an end region of the rod having a nominal diameter so as to increase the diameter of the end region to a new, upset, diameter greater than the nominal diameter; and rolling a thread onto the end region so as to produce a threaded region having a thread major diameter which is greater than the nominal diameter and a thread minor diameter which is less than the nominal diameter.

2. A method according to claim 1, wherein the step of upsetting includes using a die to receive the end region of the rod so as to form a uniform diameter in the upset end region.

3. A method according to claim 1, wherein upsetting the end region produces an upset end region having a length which is typically 110% of the thread diameter (taken from peak to peak).

4. A method according to claim 1, wherein the method further comprises a step of skimming the end region of the rod.

5. A method according to claim 4, wherein said step of skimming the end region of the rod is carried out intermediate said cold upsetting and thread rolling steps.

6. A method according to claim 1, wherein the thread minor diameter is not greater than 90% of the nominal diameter of the rod.

7. A method according to claim 1, wherein rolling the thread onto the end region produces a thread having an effective diameter larger than the nominal diameter.

8. A method according to claim 1, wherein the upset diameter of the end region of the rod is not greater than 110% of the nominal diameter D.

9. A method according to claim 1, wherein the thread is of a formation having enlarged major and minor root radii.

10. A method according to claim 1, wherein the thread is of a relatively coarse pitch, to enable a greater speed of assembly when forming a connection to the end of the rod.

11. A method according to claim 1 to 10, wherein the thread is a parallel thread.

12. A method of forming a joint between end regions of two deformed steel reinforcing rods, each of which rods has a given nominal diameter, wherein the joint has strength characteristics which are greater than or at least equal to the strength characteristics of the reinforcing rods in areas remote from said joint, the method comprising:

forming a thread on an end region of each of said rods by cold upsetting said end regions so as to increase the diameter of the end regions to a new, upset, diameter greater than the nominal diameter; and rolling a thread onto the end regions, so as to produce threaded regions having a thread major diameter, which is greater than the nominal diameter and a thread minor diameter which is less than the nominal diameter; and coupling said end regions together.

13. A joint device formed between end regions of two reinforcing steel rods having a given nominal diameter, said joint device having strength characteristics greater than or at least equal to the strength characteristics of the reinforcing rods, said joint device comprising:

an enlarged end portion formed at each of said end regions by cold-upsetting the end of each of said reinforcing steel rods, said enlarged end portion having a substantially uniform diameter greater than said nominal diameter said enlarged end portion further having a thread which is formed by thread-rolling and which has a thread major diameter greater than said nominal diameter and a thread minor diameter smaller than said nominal diameter; and a threaded coupler sleeved around said thread of said enlarged end portion of said rods.

14. A joint device according to claim 13, further comprising a nut to be sleeved around said enlarged end portion of one of said rods for locking against movement of said threaded coupler.

15. A joint device according to claim 13, wherein said enlarged end portion has a length which is typically 110% of the thread diameter (taken from peak to peak).

16. A joint device according to claim 13, wherein said thread minor diameter is not greater than 90% of said nominal diameter of the rod.

17. A joint device according to claim 13, wherein said thread has an effective diameter larger than said nominal diameter.

18. A joint device according to claim 13, wherein the diameter of said enlarged end portion is not greater than 110% of said nominal diameter.

19. A joint device according to claim 13, wherein said thread is of a formation having enlarged major and minor root radii.

20. A joint device according to claim 13, wherein said thread is of a relative coarse pitch to enable a greater speed of assembly of the joint.

21. A joint device according to claim 13, wherein said thread is a parallel thread.

22. A method of joining first and second steel reinforcing rods having substantially identical nominal diameters using a coupler, wherein neither of said first and second rods need be rotated to join said rods, comprising the steps of:

cold upsetting an end region of each of said rods so as to increase the diameter of said end regions to a new, upset, diameter which is greater than said nominal diameter but is less than or equal to 110% of said nominal diameter;

skimming said end regions of each of said rods to remove any ridges from said end and to create a uniform diameter in said end regions;

rolling a thread onto said end regions so as to produce a threaded region on each rod wherein said threaded regions have identical major diameters which are greater than said nominal diameter and minor diameters which are less than said nominal diameter, wherein said threaded region on said second rod extends beyond said end region of said second rod and wherein a coupler can be rotated completely onto said second rod such that said end regions of said first and second rods can be abutted without interference from said coupler;

rotating a threaded coupler completely onto said threaded region of said second rod wherein said end regions of said first and second rods can be abutted without interference from said coupler;

abutting said threaded regions of said rods;

rotating said coupler such that it rotates onto first rod and until said coupler reaches a run out of said first rod.

23. A method of joining first and second steel reinforcing rods having substantially identical nominal diameters using a coupler as in claim 22 further comprising the steps of:

rotating a lock nut onto said threaded region of said second rod before said threaded coupler is rotated onto said threaded region of said second rod;

rotating said lock nut tightly against said coupler after said coupler is rotated onto said first rod.

24. A method of forming a thread on at least one end region of a deformed steel reinforcing rod, wherein the threaded region has strength characteristics which are greater than or at least equal to the strength characteristics of the un-threaded region, the method comprising:

cold upsetting an end region of the rod having a nominal diameter to increase the diameter of the end region to a new, upset, diameter greater than the nominal diameter, wherein the cold upsetting uses a die to receive the end region and form a uniform diameter thereon and wherein the new diameter is less than or equal to 110% of the nominal diameter;

skimming said end regions of said rod to remove any ridges from said end region; and rolling a thread onto the end region so as to produce a threaded region having a thread major diameter which is greater than the nominal diameter and a thread minor diameter which is less than the nominal diameter.

25. A joint formed between end regions of two reinforcing steel rods having a given nominal diameter which are substantially abutted, said joint having strength characteristics greater than or at least equal to the strength characteristics of the reinforcing rods, said joint comprising:

an enlarged end portion formed at each of said end regions by cold-upsetting the end of each of said reinforcing steel rods, said enlarged end portion having a substantially uniform diameter greater than said nominal diameter but not greater than 110% of said nominal diameter, said enlarged end portion further having a thread which is formed by thread-rolling and which has a thread major diameter greater than said nominal diameter and a thread minor diameter smaller than said nominal diameter; and a threaded coupler sleeved around said thread of said enlarged end portion of said rods.

* * * * *